US008926355B2

(12) United States Patent
Heil et al.

(10) Patent No.: US 8,926,355 B2
(45) Date of Patent: Jan. 6, 2015

(54) CONNECTOR POSITION ASSURANCE DEVICE FOR A CONNECTOR ASSEMBLY

(75) Inventors: Stefan Rudolf Heil, Wuppertal (DE); Ümit Celiker, Wuppertal (DE); Robert Klawinski, Bochum (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 13/537,609

(22) Filed: Jun. 29, 2012

(65) Prior Publication Data

US 2014/0004732 A1 Jan. 2, 2014

(51) Int. Cl.
*H01R 13/627* (2006.01)

(52) U.S. Cl.
USPC ..... 439/352

(58) Field of Classification Search
USPC ..... 439/352
See application file for complete search history.

(56) References Cited

U.S. PATENT DOCUMENTS

| | | | | | |
|---|---|---|---|---|---|
| 4,634,204 | A | | 1/1987 | Detter et al. | |
| 4,892,490 | A | | 1/1990 | Tsuchiya et al. | |
| 4,938,710 | A | | 7/1990 | Aihara et al. | |
| 4,946,395 | A | * | 8/1990 | Cope et al. | 439/352 |
| 4,946,404 | A | * | 8/1990 | Takenouchi et al. | 439/352 |
| 4,950,179 | A | * | 8/1990 | Takenouchi et al. | 439/352 |
| 5,120,255 | A | * | 6/1992 | Kouda et al. | 439/489 |
| 5,234,356 | A | * | 8/1993 | Maejima et al. | 439/352 |
| 5,257,944 | A | | 11/1993 | Kennedy | |
| 5,330,369 | A | * | 7/1994 | Nozaki et al. | 439/489 |
| 5,370,550 | A | | 12/1994 | Alwine et al. | |
| 5,507,666 | A | * | 4/1996 | Yamanashi | 439/489 |
| 5,605,471 | A | | 2/1997 | Plyler | |
| 5,605,472 | A | * | 2/1997 | Sakai et al. | 439/489 |
| 5,624,271 | A | | 4/1997 | Childs et al. | |
| 5,643,003 | A | | 7/1997 | Myer et al. | |
| 5,672,073 | A | * | 9/1997 | Matsumura et al. | 439/489 |
| 5,720,623 | A | * | 2/1998 | Polenick et al. | 439/352 |
| 5,759,058 | A | * | 6/1998 | Childs et al. | 439/352 |
| 5,775,930 | A | * | 7/1998 | Model et al. | 439/352 |
| 5,803,651 | A | * | 9/1998 | Saito | 403/329 |
| 5,823,814 | A | | 10/1998 | Alwine | |
| 5,839,915 | A | * | 11/1998 | Ford et al. | 439/489 |
| 5,879,180 | A | * | 3/1999 | Iwahori et al. | 439/352 |
| 5,910,027 | A | * | 6/1999 | Wayt et al. | 439/489 |
| 5,928,038 | A | * | 7/1999 | Berg et al. | 439/752 |
| 6,004,153 | A | * | 12/1999 | Myer et al. | 439/352 |

(Continued)

FOREIGN PATENT DOCUMENTS

EP 0655807 A2 5/1995

*Primary Examiner* — Ross Gushi
(74) *Attorney, Agent, or Firm* — MacMillan, Sobanski & Todd, LLC

(57) ABSTRACT

A connector assembly is provided with a first member and a second member that is removably connected to the first member. The second member has a deflectable latch that secures the first and second members together. A connector position assurance device is movably supported on the second member. The connector position assurance device includes a body portion and a deflectable locking arm that extends from the body portion. The connector position assurance device is movable between a first position, wherein the locking arm is in contact with the latch to lock the connector position assurance device in the first position and to deflect the locking arm when the latch is deflected, and a second position, wherein the body portion is positioned adjacent to the latch to prevent deflection of the latch, only after the first and second members are secured together by the latch.

20 Claims, 6 Drawing Sheets

(56) References Cited

U.S. PATENT DOCUMENTS

| | | | | |
|---|---|---|---|---|
| 6,045,388 | A * | 4/2000 | Higgins et al. | 439/352 |
| 6,068,507 | A * | 5/2000 | Popa | 439/489 |
| 6,109,955 | A * | 8/2000 | Hanazaki et al. | 439/489 |
| 6,244,890 | B1 | 6/2001 | Fuerst et al. | |
| 6,261,115 | B1 | 7/2001 | Pederson et al. | |
| 6,261,116 | B1 * | 7/2001 | Ceru | 439/352 |
| 6,312,277 | B1 * | 11/2001 | Holub | 439/352 |
| 6,354,860 | B1 * | 3/2002 | Miller et al. | 439/352 |
| 6,406,319 | B2 * | 6/2002 | Pederson et al. | 439/352 |
| 6,435,895 | B1 * | 8/2002 | Fink et al. | 439/352 |
| 6,461,186 | B1 * | 10/2002 | Endo | 439/352 |
| 6,468,105 | B2 * | 10/2002 | Noguchi et al. | 439/489 |
| 6,514,098 | B2 | 2/2003 | Marpoe et al. | |
| 6,572,400 | B2 * | 6/2003 | Noguchi et al. | 439/489 |
| 6,592,390 | B1 | 7/2003 | Davis et al. | |
| 6,659,789 | B2 * | 12/2003 | Nagamine et al. | 439/352 |
| 6,716,052 | B2 * | 4/2004 | Kane | 439/352 |
| 6,780,045 | B2 * | 8/2004 | Shuey et al. | 439/489 |
| 6,817,883 | B2 | 11/2004 | Raudenbush et al. | |
| 6,824,417 | B1 * | 11/2004 | Nimura | 439/352 |
| 6,857,892 | B2 * | 2/2005 | McLauchlan et al. | 439/352 |
| 6,908,329 | B2 * | 6/2005 | Kozono et al. | 439/352 |
| 6,921,279 | B2 * | 7/2005 | Sian et al. | 439/352 |
| 7,201,599 | B2 | 4/2007 | Holub | |
| 7,326,074 | B1 * | 2/2008 | Lim et al. | 439/352 |
| 7,399,195 | B2 * | 7/2008 | Kim et al. | 439/352 |
| 7,442,065 | B2 * | 10/2008 | Kuwayama | 439/352 |
| 7,470,138 | B1 * | 12/2008 | Chen et al. | 439/352 |
| 7,601,019 | B2 * | 10/2009 | Hsieh et al. | 439/345 |
| 7,682,181 | B1 | 3/2010 | Jones, Jr. et al. | |
| 7,909,638 | B2 * | 3/2011 | Seo et al. | 439/489 |
| 7,980,887 | B2 * | 7/2011 | Urano et al. | 439/489 |
| 8,016,606 | B1 * | 9/2011 | Kwan et al. | 439/352 |
| 2003/0003792 | A1 | 1/2003 | Endo | |
| 2003/0096527 | A1 * | 5/2003 | Greiner | 439/352 |
| 2003/0157825 | A1 * | 8/2003 | Kane | 439/352 |
| 2003/0171027 | A1 * | 9/2003 | Shuey et al. | 439/489 |
| 2004/0087206 | A1 * | 5/2004 | Grubbs | 439/489 |
| 2004/0132329 | A1 | 7/2004 | Shimoyama et al. | |
| 2004/0157486 | A1 * | 8/2004 | Brown | 439/489 |
| 2004/0166715 | A1 | 8/2004 | Parrish et al. | |
| 2004/0248453 | A1 * | 12/2004 | McLauchlan et al. | 439/352 |
| 2004/0248459 | A1 * | 12/2004 | Sian et al. | 439/489 |
| 2005/0142923 | A1 | 6/2005 | Horiuchi | |
| 2005/0176297 | A1 * | 8/2005 | Dillon | 439/595 |
| 2005/0208818 | A1 | 9/2005 | Mtchedlishvili et al. | |
| 2006/0223355 | A1 | 10/2006 | Hirschmann | |
| 2007/0161284 | A1 * | 7/2007 | Tyler | 439/489 |
| 2008/0124966 | A1 * | 5/2008 | Lim | 439/357 |
| 2009/0023325 | A1 * | 1/2009 | Chen et al. | 439/352 |
| 2009/0035981 | A1 * | 2/2009 | Lim | 439/352 |
| 2010/0233897 | A1 * | 9/2010 | Seo et al. | 439/345 |
| 2012/0156917 | A1 * | 6/2012 | Sasho et al. | 439/352 |
| 2012/0282791 | A1 * | 11/2012 | Brown et al. | 439/157 |
| 2013/0078835 | A1 * | 3/2013 | Gunreben et al. | 439/188 |
| 2013/0210266 | A1 * | 8/2013 | Osada et al. | 439/378 |
| 2013/0260590 | A1 * | 10/2013 | Hitchcock et al. | 439/312 |

* cited by examiner

CONNECTOR POSITION ASSURANCE DEVICE FOR A CONNECTOR ASSEMBLY

BACKGROUND OF THE INVENTION

This invention relates in general to connector position assurance devices, such as can be used to ensure proper connection between mating components of a connector assembly. In particular, this invention relates to an improved connector position assurance device that is relatively simple in structure and easy to operate.

Connector assemblies are commonly used to create electrical connections by using separate mating components. A typical connector assembly includes a female connector housing having at least one electrical terminal and a male connector body having at least one electrical terminal. The connector body is inserted into the connector housing so that the electrical terminals engage one another and create an electrical connection. A flexible latch or the like is typically provided on the connector housing for securing the mating components together.

In certain applications, it is known to provide the connector assembly with a connector position assurance device, commonly referred to as a CPA device. A typical CPA device is supported on either the connector body or the connector housing for movement between a pre-lock position and a locked position. The CPA device is secured in the pre-lock position when the mating components are not fully assembled to one another. Once the mating components are fully assembled together, the CPA device can then be moved to the locked position. Thus, the CPA device ensures a proper connection between the mating components before it can be moved to the locked position. In the locked position, the CPA device also prevents the mating components from being separated from one another. However, most CPA devices that accomplish these functions are generally complex in their structure and can be relatively difficult to operate between the pre-lock and locked positions. Thus, it would be desirable to provide an improved CPA device that is relatively simple in structure and easy to operate.

SUMMARY OF THE INVENTION

This invention relates to an improved connector assembly having a connector position assurance device. The connector assembly includes a first member and a second member that is removably connected to the first member. The second member has a deflectable latch that secures the first and second members together. A connector position assurance device is movably supported on the second member. The connector position assurance device includes a body portion and a deflectable locking arm that extends from the body portion. The connector position assurance device is movable between a first position, wherein the locking arm is in contact with the latch to lock the connector position assurance device in the first position and to deflect the locking arm when the latch is deflected, and a second position, wherein the body portion is positioned adjacent to the latch to prevent deflection of the latch, only after the first and second members are secured together by the latch.

This invention also relates to a connector position assurance device for use with a connector assembly. The connector position assurance device includes a body portion having at least one guide section and a projection that extends outwardly from a surface of the guide section. A single locking arm extends from the body portion, wherein the locking arm has a protrusion that extends outwardly from a surface of the locking arm. The protrusion is defined by a first contact surface that extends at a first angle from the locking arm and a second contact surface that extends at a second angle from the locking arm and intersects the first contact surface to form the protrusion. A third contact surface extends inwardly from the second contact surface and is generally perpendicular to the locking arm. A fourth contact surface extends from the third contact surface and is generally parallel with the locking arm.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
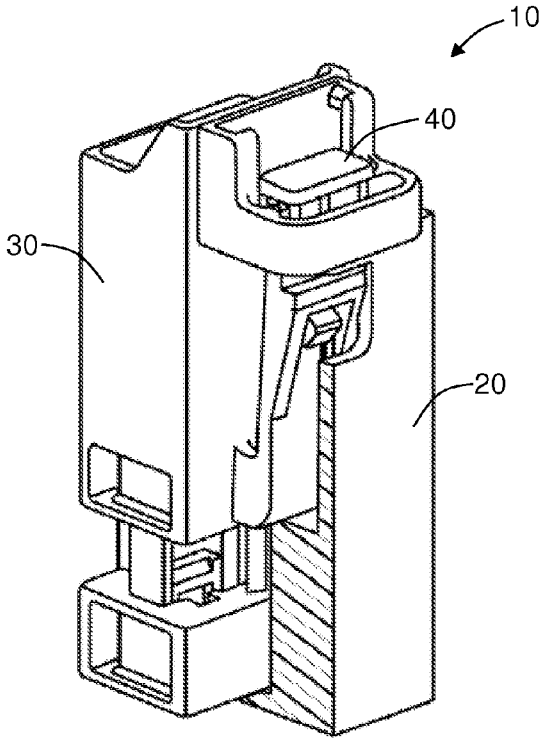
FIG. 1 is a perspective view of a connector assembly including a connector housing, a connector body, and a connector position assurance (CPA) device illustrated with the connectors in a fully assembled position and the CPA device in a locked position.

Referring now to the drawings, there is illustrated in FIG. 1 a connector assembly, indicated generally at 10, in accordance with this invention. The illustrated connector assembly 10 includes a first member or connector housing 20 and a mating second member or connector body 30. The connector housing 20 may include at least one electrical contact (not shown), such as a male electrical terminal, and the connector body 30 may also include at least one electrical contact (not shown), such as a female electrical terminal. The connector body 30 can be inserted into the connector housing 20 so that the electrical contacts engage one another and create an electrical connection. A connector position assurance (CPA) device 40 is supported on the connector body 30. As will be further explained below, the CPA device 40 is configured to ensure a proper connection between the connector housing 20 and the connector body 30 and to lock the connectors together. It should be appreciated, however, that the connector assembly 10 or the CPA device 40 can be used in any desired environment and for any desired purpose.

Figure 2:
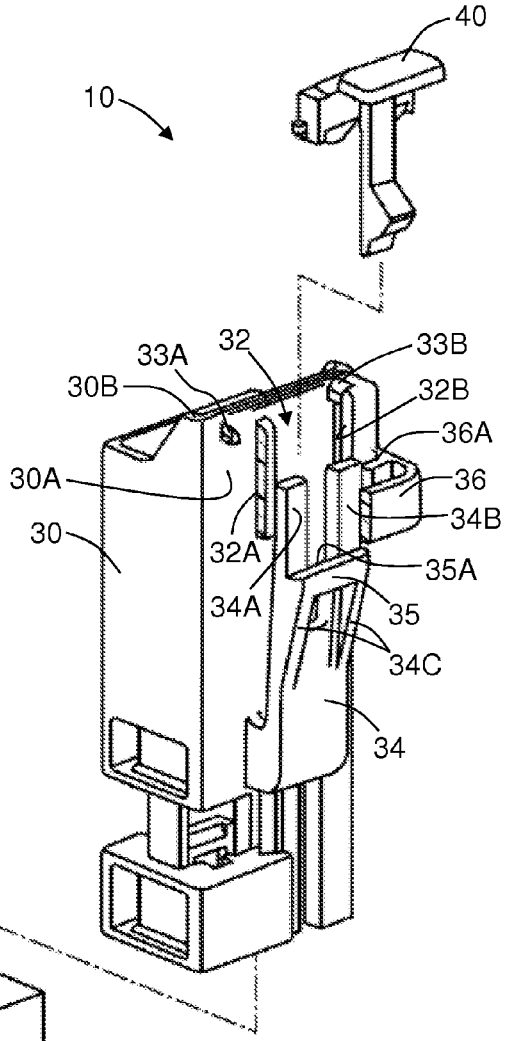
FIG. 2 is an exploded view of the connector assembly shown in FIG. 1.
Figure 2:
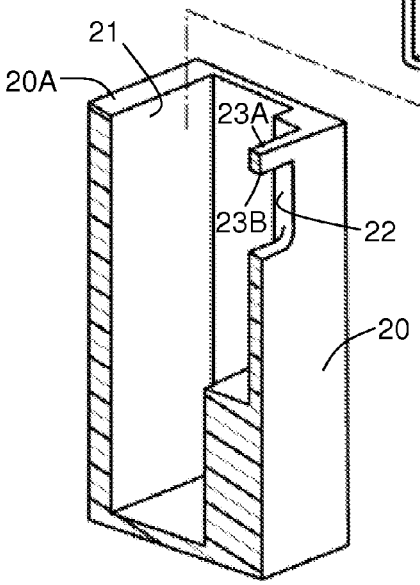

Referring now to FIG. 2, the connector assembly 10 is shown in an unassembled position. The illustrated connector housing 20 (i.e., shown in cross-section) is a generally hollow, female member having a chamber 21 with an opening at one end 20A thereof. The chamber 21 may have any cross-sectional shape as desired, the purposes of which will be explained below. It should be appreciated that the connector housing 20 can be formed from an electrically non-conductive material, such as a plastic or the like.

In the illustrated embodiment, a window 22 preferably extends through an outer wall of the connector housing 20 for communication with the chamber 21. The illustrated window 22 is located near the open end 20A of the connector housing 20. The window 22 can define any shape as desired. A first edge 23A is defined by the open end 20A of the connector housing 20 and the window 22 defines a second edge 23B that faces in an opposite direction from the first edge 23A, the purpose of which will be explained below. As shown, the first and second edges 23A and 23B may be generally flat planar surfaces. However, one or both of the edges 23A and 23B can be otherwise shaped if so desired, such as for example having chamfered or beveled edges.

In alternative embodiments, the connector housing 20 may have any construction, shape, or configuration other than as illustrated and described above. For example, the connector housing 20 may have multiple chambers 21 that are configured to receive any number of male connectors 30. In yet another example, the chamber 21 may have internal grooves (not shown) that properly align the connector body 30 therein. In yet another example, the connector housing 20 may define a recessed portion (not shown) that extends into an inner wall of the chamber 21 as opposed to a window 22 that extends all the way through the wall. Thus, it should be fully appreciated that the connector housing 20 is not limited to the illustrated embodiment.

As mentioned above, the connector body 30 is configured to be inserted into the chamber 21 of the connector housing 20 to form a mating connection therewith. Thus, a portion of the illustrated connector body 30 may have a cross-sectional shape that generally corresponds with the cross-sectional shape of the chamber 21, although such is not required. The connector body 30 can be formed from an electrically non-conductive material, such as a plastic or the like.

In the illustrated embodiment, the connector body 30 preferably includes a guide channel, indicated generally at 32. The guide channel 32 is defined by a pair of guide walls 32A and 32B, although such is not required. The illustrated guide walls 32A and 32B are generally L-shaped members that are spaced apart from one another and extend along an outer surface 30A of the connector body 30. Preferably, the guide channel 32 is located near an end portion 30B of the connector body 30 but, alternatively, can extend along any portion thereof. The guide walls 32A and 32B are integrally formed with the connector body 30. However, the guide walls 32A and 32B may be separate components that are attached to the connector body 30. The guide channel 32 may also include a pair of stop tabs 33A and 33B, which are respectively provided on inner facing surfaces of the guide walls 32A and 32B. The stop tabs 33A and 33B are preferably located near the end portion 30B of the connector body 30, but may be located along any portion of the guide channel 32.

The illustrated connector body 30 also preferably includes a deflectable latch 34. For example, the illustrated latch 34 is an elongated member that is secured at a first end to the outer surface 30A of the connector body 30 and axially extends along the outer surface 30A in a cantilevered fashion. As a result of the material from which the connector body 30 is made, the latch 34 is deflectable between a first or relaxed position (see FIGS. 5, 7, and 8) and a second or flexed position (see FIG. 6). The latch 34 can be integrally formed with the connector body 30 or, alternatively, may be a separate component that is attached thereto. A second or cantilevered end of the latch 34 is preferably bifurcated thereby forming a pair of end portions 34A and 34B that are laterally spaced apart from one another. As shown, the end portions 34A and 34B longitudinally extend between the guide walls 32A and 32B of the guide channel 32, the purpose of which will be explained below. Alternatively, the latch 34 may have any shape or configuration to accomplish the functions described herein and below.

In the illustrated embodiment, a cross-member 35 preferably extends between the end portions 34A and 34B of the latch 34 and is located along an intermediate length thereof. The illustrated cross-member 35 defines a stepped surface 35A that extends outwardly from respective outer surfaces of the end portions 34A and 34B in a generally perpendicular manner. The illustrated stepped surface 35A faces the cantilevered or free end of the latch 34. The illustrated latch 34 also defines a pair of tapered surfaces 34C that extend from the first end thereof to the cross-member 35, although such is not necessarily required. It should be appreciated that the latch 34 is not limited to the illustrated embodiment but may include other structural features or can be configured in any other manner.

In the illustrated embodiment, the connector body 30 also preferably includes a latch guard 36. The latch guard 36 is a semi-annular member that is supported at opposite ends on the guide walls 32A and 32B of the guide channel 32. The latch guard 36 extends outwardly from the outer surface 30A of the connector body 30 over a portion of the guide channel 32 and the end portions 34A and 34B of the latch 34. The latch guard 36 can be integrally formed with the connector body 30 or, alternatively, may be a separate component that is attached thereto.

The illustrated latch guard 36 also preferably includes a pair of opposing ribs 36A that extend inwardly from opposite inner walls of the latch guard 36, although such is not required. The ribs 36A overlap or otherwise interfere with the end portions 34A and 34B of the latch 34 so as to limit pivotal movement of the latch 34 in a direction away from the outer surface 30A of the body 30. As such, the ribs 36A limit the maximum stress at the first end of the latch 34 where it is secured to the connector body 30. The ribs 36A also help to prevent the CPA device 40 from being moved to a locked position during transport or handling of the connector body 30 by maintaining the latch 34 in a position for contact with the CPA device 40, as will become apparent.

In alternative embodiments, the connector body 30 may have any construction, shape, or configuration other than as illustrated and described above. For example, the connector body 30 may include external guide portions (not shown) to properly align the connector body 30 within the chamber 21 of the connector housing 20. In another example, the guide channel 32 may include a groove (not shown) that extends into the outer surface 30A of the connector body 30 to facilitate alignment of the CPA device 40 in the guide channel 32. In yet another example, the latch 34 may be biased in the first position by a spring member (not shown) or the like. Thus, it should be fully appreciated that the connector body 30 is not limited to the illustrated embodiment. Further, it should be appreciated that the connector housing 20 and the connector body 30 can be used without the CPA device 40 if so desired. As such, the connector housing 20 and/or the connector housing 30 can have a standard design that is suitable for use with or without the CPA device 40, which can provide costs savings.

Figure 3:
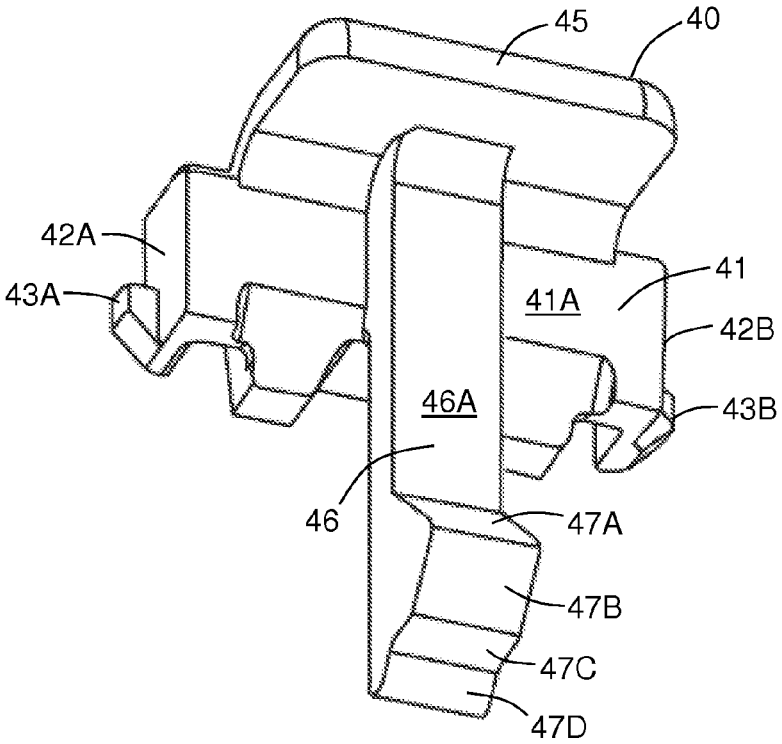
FIG. 3 is an enlarged perspective view of the CPA device shown in FIGS. 1 and 2.
Figure 4:
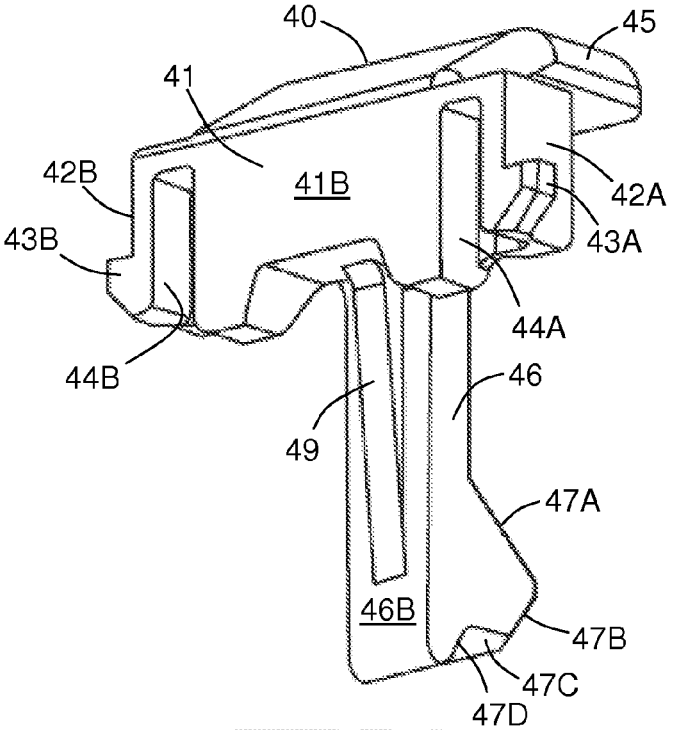
FIG. 4 is an enlarged perspective view of a back side of the CPA device shown in FIG. 3.

Referring now to FIGS. 3 and 4, the CPA device 40 will be described in further detail. In general, the CPA device 40 preferably includes a body 41, a ledge 45 that extends along an upper portion of the body 41, and a locking arm 46 that extends from a bottom portion of the body 41. Preferably, the CPA device 40 is integrally made from a substantially resilient material, such as a plastic or the like. However, it should be appreciated that the CPA device 40 can be made from any suitable material using any methods or processes.

In the illustrated embodiment, the body 41 preferably includes a pair of guide sections 42A and 42B that are, in large part, embodied as opposite edges of the body 41. The illustrated guide sections 42A and 42B are configured to be inserted within the respective guide walls 32A and 32B of the guide channel 32 on the connector body 30. As such, the CPA device 40 is supported for sliding movement on the connector body 30, as will be further explained below. Alternatively, the CPA device 40 can be movably supported on the connector body 30 in any other manner.

The illustrated guide sections 42A and 42B include projections 43A and 43B that are respectively located on laterally outward facing surfaces thereof. The projections 43A and 43B extend outwardly from the guide sections 42A and 42B and are preferably located near a rear surface 41B of the body 41, although such is not required. As shown in FIG. 4, hollow regions or cavities 44A and 44B respectively extend into the rear surface 41B of the body 41 near each of the guide sections 42A and 42B. Thus, portions of the guide sections 42A and 42B located near the rear surface 41B are able to flex between a relaxed position and a flexed position to facilitate assembly of the CPA device 40 in the guide channel 32 on the connector body 30. It should be appreciated, however, that the body 41 can be configured in any manner to accomplish the functions described herein and below.

As briefly mentioned above, an upper portion of the CPA device 40 preferably includes a ledge 45, although such is not required. The illustrated ledge 45 extends outwardly from a front surface 41A of the body 41 and has a generally flat upper surface. Alternatively (or in addition), the ledge 45 may have a contoured surface, a textured surface, or any other structural features. As will become apparent, the ledge 45 is configured to facilitate sliding movement of the CPA device 40 relative to the connector body 30, such as with a person's finger or the like.

In the illustrated embodiment, the locking arm 46 preferably extends from a bottom portion of the body 41. The locking arm 46 is a deflectable member that can be moved from a first or relaxed position (see FIGS. 5 and 8) to a second or flexed position (see FIGS. 6 and 7). For example, the locking arm 46 is able to deflect as a result of the material from which the CPA device 40 is made. In the relaxed position, front and rear surfaces 46A, 46B of the locking arm 46 are generally parallel with the front and rear surfaces 41A, 41B of the body 41, although such is not required. Alternatively, the locking arm 46 may extend from any portion of the body 41 and can be movable between the first and second positions in any manner.

A distal end of the locking arm 46 defines a plurality of contact surfaces, the purposes of which will be explained below. For example, the illustrated locking arm 46 preferably has a first or upper contact surface 47A. The first contact surface 47A extends outwardly from the front surface 46A of the locking arm 46 and is oriented at a first angle relative thereto. A second or intermediate contact surface 47B preferably extends inwardly from a lower edge of the first contact surface 47A and is oriented at a second angle relative to the front surface 46A of the locking arm 46. Thus, the first contact surface 47A and the second contact surface 47B intersect with one another to form an apex that extends outwardly from the front surface 46A of the locking arm 46. A third or lower contact surface 47C preferably extends inwardly from a lower edge of the second contact surface 47B and is generally perpendicular to the front surface 46A of the locking arm 46. A fourth contact surface 47D preferably extends from the third contact surface 47C and is generally parallel with the front surface 46A of the locking arm 46 (i.e. defines an end portion of the locking arm 46). As will be explained below, the locking arm 46 is pivoted from the relaxed position to the flexed position when either of the first contact surface 47A, the second contact surface 47B, or the fourth contact 47D comes into contact with the connector housing 20 or the connector body 30. It should be fully appreciated, however, that the locking arm 46 may include any number or configuration of contact surfaces to accomplish the functions described herein and below.

As shown in FIG. 4, the locking arm 46 also preferably includes a support rib 49, although such is not required. The illustrated support rib 49 extends from the body 41 of the CPA device 40 along the rear surface 46B of the locking arm 46. A height of the support rib 49 (i.e., extending outwardly from the rear surface 46B of the locking arm 46) decreases along a length of the locking arm 46, although such is not required. The support rib 49 can have any dimensions or configuration to obtain a desired resiliency in the locking arm 46.

In alternative embodiments, the CPA device 40 may have any construction, shape, or configuration other than as illustrated and described above. For example, the body 41 may include guide ribs (now shown) or any other structural features to facilitate proper alignment within the guide channel 32 of the connector body 30. In another example, the locking arm 46 and/or the contact surfaces 47A, 47B, 47C, and 47D can be oriented in any manner relative to the body 41. Thus, it should be fully appreciated that the CPA device 40 is not limited to the illustrated embodiment.

Figure 5:
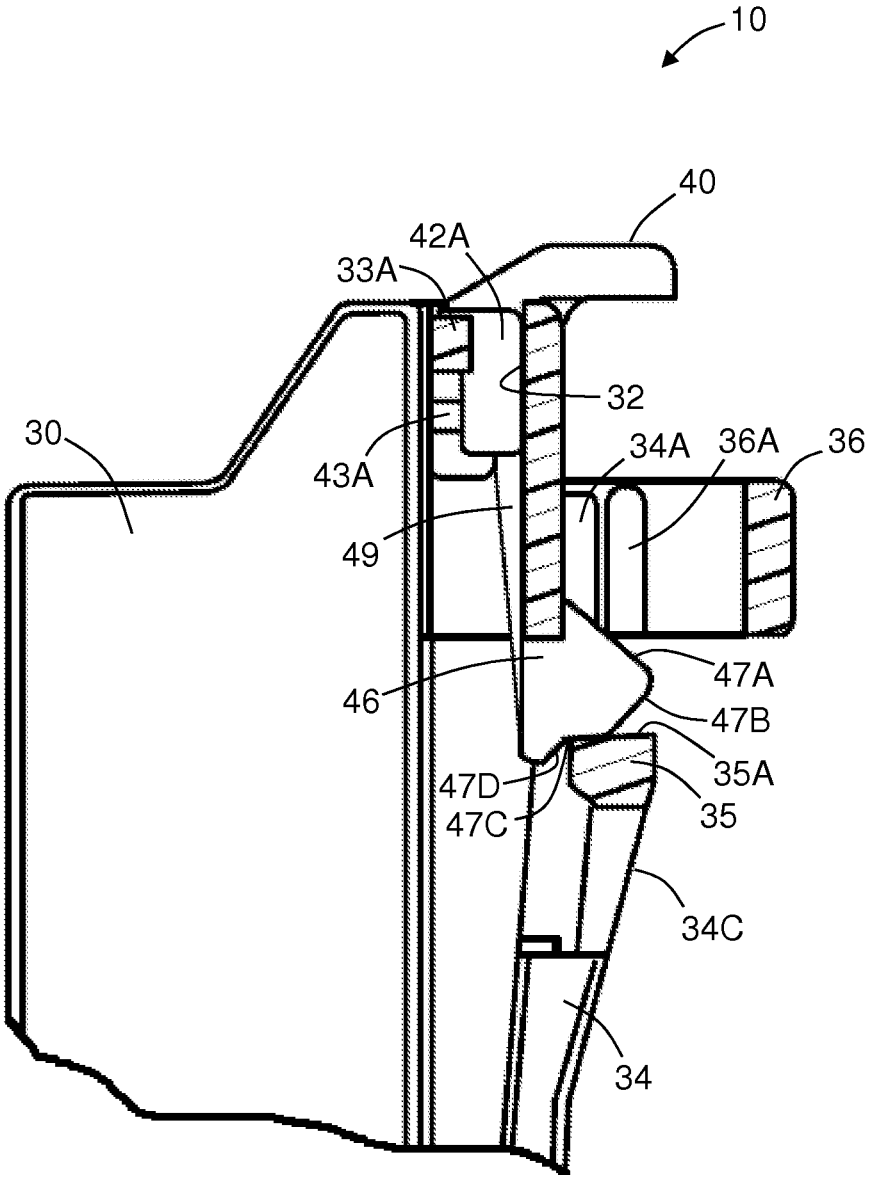
FIG. 5 is a partial cross-sectional side view of the connector body and the CPA device shown in FIGS. 1 and 2, with the CPA device in a pre-locked position.
Figure 6:
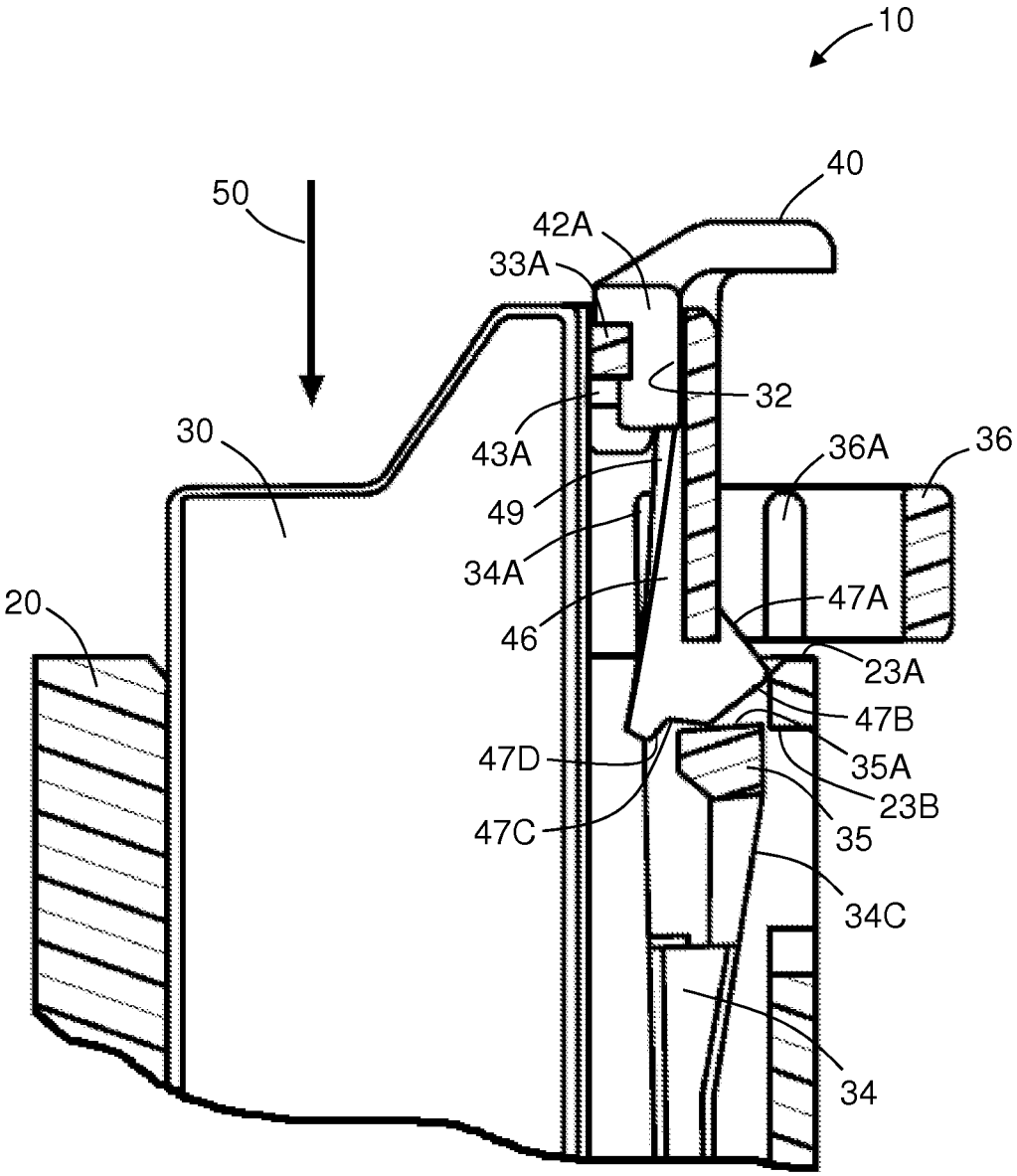
FIG. 6 is a partial cross-sectional side view of the connector assembly shown in FIG. 1, with the connector body partially assembled together with the connector housing and the CPA device in the pre-locked position.

Referring now to FIGS. 5 through 8, steps for operating the CPA device 40 between a first or pre-locked position (see FIGS. 5 through 7) and a second or locked position (see FIG. 8) will be described. As shown in FIGS. 5 and 6, the CPA device 40 is initially supported on the connector body 30 in the pre-locked position. The guide sections 42A and 42B of the CPA device 40 are disposed for sliding movement within the guide channel 32 of the connector body 30. The locking arm 46 of the CPA device 40 extends between the bifurcated end portions 34A and 34B of the latch 34. The third contact surface 47C of the locking arm 46 is seated against the stepped surface 35A of the cross member 35, which prevents the CPA device 40 from being moved to the locked position. The projections 43A and 43B on the CPA device 40 are configured to engage the stop tabs 33A and 33B in the guide channel 32 to prevent the CPA device 40 from being moved in an opposite direction through an open upper end of the guide channel 32.

If the latch 34 on the connector body 30 is accidently moved to the flexed position prior to assembly of the connector body 30 with the connector housing 20, then the cross-member 35 of the latch 34 contacts the fourth contact surface 47D of the locking arm 46 and pivots the locking arm 46 therewith. The third contact surface 47C of the locking arm 46 remains in contact with the stepped surface 35A of the cross-member 35. Thus, the CPA device 40 cannot be moved to the locked position even if the latch 34 is accidentally pivoted to the flexed position prior to assembly of the connector body 30 with the connector housing 20.

As shown in FIG. 6, the connector body 30 is initially inserted into the chamber 21 of the connector housing 20. As the connector body 30 continues to be inserted into the chamber 21, as indicated by arrow 50, the tapered surfaces 34C of the latch 34 contact the first edge 23A of the connector housing 20. The first edge 23A pivots the latch 34 from the relaxed position toward the flexed position. As the latch 34 pivots toward the flexed position, the cross-member 35 contacts the fourth contact surface 47D of the locking arm 46 and pivots the locking arm 46 from its relaxed position toward the flexed position. As the connector body 30 continues to be inserted into the connector housing 20, the second contact surface 47B of the locking arm 46 comes into contact with the first edge 23A of the connector housing 20, thereby further pivoting the locking arm 46 toward the flexed position. As best shown in FIG. 6, the fourth contact surface 47D begins to move away from the cross-member 35 and the third contact surface 47C begins to separate from the stepped surface 35A of the cross-member 35.

Figure 7:
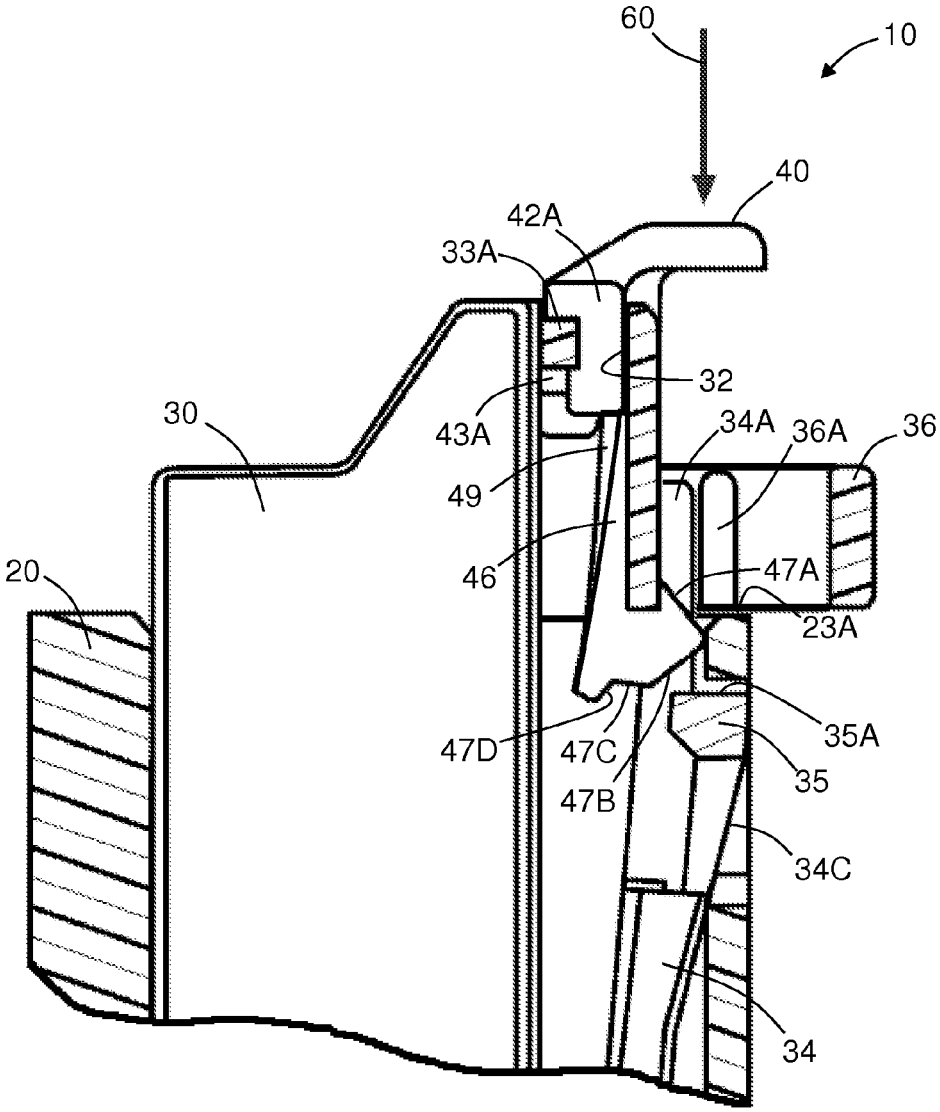
FIG. 7 is a partial cross-sectional side view of the connector assembly shown in FIG. 6, with the connectors fully assembled and the CPA device in the pre-locked position.

Once the connector body 30 is fully inserted within the connector housing 20, as shown in FIG. 7, the cross-member 35 of the latch 34 is no longer in contact with an inner surface of the connector housing 20. Thus, the latch 34 returns to the relaxed position and the cross-member 35 extends into the window 22 of the connector housing 20. The apex of the locking arm 46 remains in contact with the inner surface of the connector housing 20 between the first and second edges 23A and 23B, thereby holding the locking arm 46 in the flexed position. As a result, the third contact surface 47C is fully removed from the stepped surface 35A of the cross-member 35. The CPA device 40 can then be slid downwardly relative to the connector body 30, as indicated by arrow 60. As shown, the inner edge of the cross-member 35 extends beyond the inner surface of the connector housing 20. Thus, as the CPA device 40 is moved from the pre-locked position to the locked position, the apex of the locking arm 46 engages the cross-member 35 and provides a tactile feedback (e.g., a "snap fit" connection) to the person operating the CPA device 40.

Figure 8:
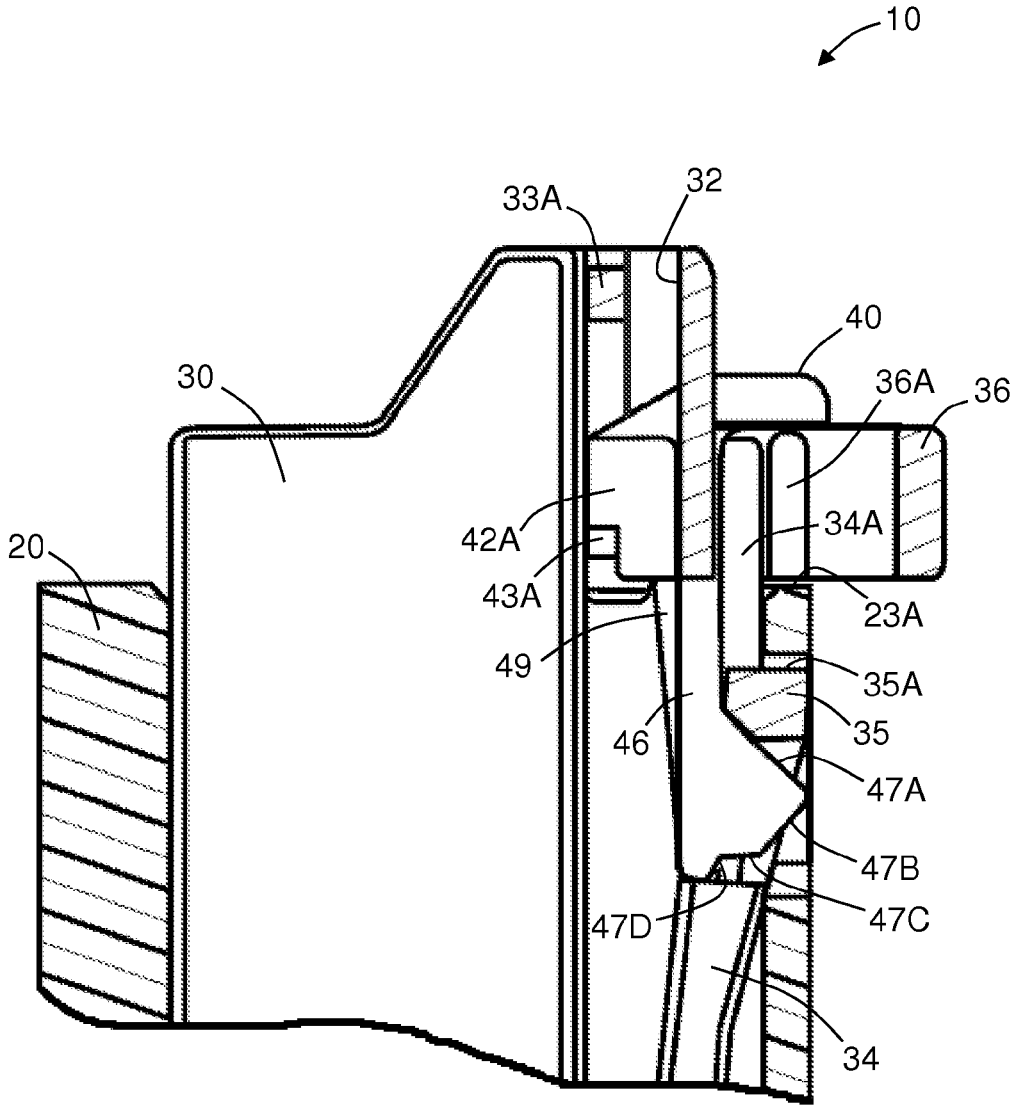
FIG. 8 is a partial cross-sectional side view of the connector assembly shown in FIG. 7, with the connectors fully assembled and the CPA device in the locked position.

When the CPA device 40 reaches the locked position, as shown in FIG. 8, the locking arm 46 returns to the relaxed position and the apex thereof extends into the window 22 of the connector housing 20. The first contact surface 47A of the locking arm 46 is positioned directly adjacent to a lower edge of the cross-member 35, which deters the CPA device 40 from being accidentally moved from the locked position back to the pre-locked position. In the locked position, the body 41 of the CPA device 40 is disposed between the latch 34 (i.e., the end portions 34A and 34B) and the outer surface 30A of the connector body 30. This prevents pivotal movement of the latch 34 from the relaxed position to the flexed position, which would unlock the connector assembly 10.

To disassemble the connector body 30 from the connector housing 20, the CPA device 40 can be moved from the locked position back to the pre-locked position. To accomplish this, a tool such as a screwdriver (not shown) or the like can be inserted between the latch guard 36 and a bottom surface of the ledge 45 that extends from the CPA device 40. The tool can then be used to apply an upward force on the ledge 45 by using the latch guard 36 as a fulcrum in order to pry the CPA device 40 from the locked position. In doing so, the first contact surface 47A of the locking arm 46 contacts the lower edge of the cross-member 35, thereby pivoting the locking arm 46 from the relaxed position to the flexed position until it clears the cross-member 35. Once the CPA device 40 is moved to the pre-locked position, the body 41 is no longer disposed between the latch 34 (i.e., the end portions 34A and 34B) and the outer surface 30A of the connector body 30. Thus, the latch 34 can be pivoted from the relaxed position to the flexed position in order to remove the connector body 30 from the connector housing 20. It should be appreciated that the steps described herein and above can be repeated any number of times.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A connector assembly comprising:

a first member including a window defining an edge;

a second member removably connected to the first member, the second member having a deflectable latch that secures the first and second members together; and a connector position assurance device movably supported on the second member, the connector position assurance device including a body portion and a deflectable locking arm that extends from the body portion, the connector position assurance device being movable between a first position, wherein the locking arm is in contact with the latch to lock the connector position assurance device in the first position and to deflect the locking arm when the latch is deflected, and a second position, wherein the body portion is positioned adjacent to the latch to prevent deflection of the latch, only after the first and second members are secured together by the latch, wherein the latch contacts the edge of the window to secure the first and second members together.

2. The connector assembly of claim 1, wherein the first member has an internal chamber for receiving a portion of the second member.

3. The connector assembly of claim 2, wherein the window extends through a wall of the first member for communication with the internal chamber.

4. The connector assembly of claim 1, wherein the latch on the second member has a bifurcated end.

5. The connector assembly of claim 4, wherein the locking arm of the connector position assurance device is disposed between the bifurcated end of the latch.

6. The connector assembly of claim 4, wherein the latch includes a cross-member that extends between the bifurcated end thereof.

7. The connector assembly of claim 6, wherein the cross-member defines a contact surface that extends outwardly in a generally perpendicular manner from outer surfaces of the bifurcated end.

8. The connector assembly of claim 1, wherein the second member further includes at least one rib that overlaps with an outer surface of the latch to limit movement of the latch.

9. The connector assembly of claim 1, wherein the connector position assurance device is supported for sliding movement within a guide channel on the second member.

10. The connector assembly of claim 9, wherein the guide channel includes at least one stop tab that prevents the connector position assurance device from being removed from the guide channel.

11. The connector assembly of claim 1, wherein the body portion of the connector position assurance device includes at least one guide section having a projection that extends outwardly from a surface thereof.

12. The connector assembly of claim 11, wherein at least a portion of the guide section is deflectable relative to the body portion.

13. The connector assembly of claim 12, wherein the body portion includes a cavity located adjacent to the guide section such that the guide section is deflectable between a relaxed position and a flexed position.

14. The connector assembly of claim 1, wherein the locking arm of the connector position assurance device includes a first contact surface and a second contact surface that extend outwardly from a surface thereof and intersect one another to form a protrusion.

15. The connector assembly of claim 14, wherein the locking arm further includes a third contact surface that extends inwardly from the second contact surface and is generally perpendicular to the locking arm.

16. The connector assembly of claim 15, wherein the locking arm further includes a fourth contact surface that extends from the third contact surface and is generally parallel with the locking arm.

17. A connector position assurance device comprising:

a body portion having a surface and at least one guide section, a projection that extends outwardly from the guide section; and a single locking arm extending from the body portion and including a surface that, in a relaxed position, extends generally parallel with the surface of the body, wherein the locking arm has a protrusion that extends outwardly from the surface of the locking arm and includes a first contact surface that extends at an relative to the surface of the locking arm, a second contact surface that extends from the first contact surface at a second angle relative to the surface of the locking arm, a third contact surface that extends from the second contact surface and is generally perpendicular to the surface of the locking arm, and a fourth contact surface that extends from the third contact surface and is generally parallel with the locking arm.

18. The connector position assurance device of claim 17, wherein the body portion includes a cavity that is located adjacent to the guide section such that the guide section is deflectable between a relaxed position and a flexed position.

19. A connector assembly comprising:

a first member having an internal chamber and a window that extends through a wall thereof for communication with the internal chamber;

a second member removably inserted within the first member, the second member including: a guide channel; a deflectable latch having a bifurcated end that extends within the guide channel; a cross-member extending between the bifurcated end of the latch that is configured to contact an edge of the window in the first member to secure the first and second members together; and a rib that overlaps with an outer surface of the latch to limit pivotal movement of the latch; and a connector position assurance device movably supported on the second member, the connector position assurance device including: a body portion having at least one guide section that is disposed for sliding movement within the guide channel on the second member; and a single locking arm extending from the body portion between the bifurcated end of the latch, the locking arm including a protrusion having a first contact surface that extends at a first angle from the locking arm, a second contact surface that extends at a second angle from the locking arm and intersects with the first contact surface to form the protrusion, a third contact surface that extends from the second contact surface and is generally perpendicular to the locking arm, and a fourth contact surface that extends from the third contact surface and is generally parallel with the locking arm.

20. The connector assembly of claim 19, wherein the connector position assurance device is movable between a first position, wherein the third contact surface of the locking arm is in contact with the cross-member of the latch to lock the connector position assurance device in the first position and the fourth contact surface is in contact with the cross-member of the latch to deflect the locking arm when the latch is deflected, and a second position, wherein the body portion is positioned adjacent to the bifurcated end of the latch to prevent deflection of the latch, only after the first and second members are secured together by the latch.

* * * * *